US007243722B2

(12) United States Patent
Oosterling et al.

(10) Patent No.: US 7,243,722 B2
(45) Date of Patent: Jul. 17, 2007

(54) EXPANDER DEVICE

(75) Inventors: Peter Oosterling, Berkelen Roderijs (NL); Alan MacKenzie, Scotland (GB)

(73) Assignee: e2Tech Limited, Houston, TX (US)

( * ) Notice: Subject to any disclaimer, the term of this patent is extended or adjusted under 35 U.S.C. 154(b) by 226 days.

(21) Appl. No.: 10/470,393

(22) PCT Filed: Jan. 28, 2002

(86) PCT No.: PCT/GB02/00356

§ 371 (c)(1),
(2), (4) Date: Jan. 20, 2004

(87) PCT Pub. No.: WO02/059456

PCT Pub. Date: Aug. 1, 2002

(65) Prior Publication Data

US 2005/0173129 A1 Aug. 11, 2005

(30) Foreign Application Priority Data

Jan. 26, 2001 (GB) ..... 0102021.3

(51) Int. Cl.
*E21B 29/10* (2006.01)
*E21B 23/04* (2006.01)

(52) U.S. Cl. ..... 166/277; 166/212; 166/217

(58) Field of Classification Search ..... 166/277, 166/383, 207, 212, 217; 72/370.06, 370.08
See application file for complete search history.

(56) References Cited

U.S. PATENT DOCUMENTS 1,467,821 A * 9/1923 Tuttle ..... 82/169
1,619,254 A * 3/1927 Hart ..... 294/86.15
2,627,891 A 2/1953 Clark ..... 153/82
3,087,552 A * 4/1963 Graham ..... 166/243
3,179,168 A * 4/1965 Vincent ..... 166/277
3,191,677 A * 6/1965 Kinley ..... 166/277
3,191,680 A * 6/1965 Vincent ..... 166/387
3,245,471 A * 4/1966 Howard ..... 166/387
3,311,172 A * 3/1967 Shapiro et al. ..... 166/212
3,545,543 A * 12/1970 Johnson ..... 166/212
3,785,193 A * 1/1974 Kinley et al. ..... 72/393
4,319,393 A * 3/1982 Pogonowski ..... 29/434
4,957,162 A * 9/1990 Etourmy et al. ..... 166/212

(Continued)

FOREIGN PATENT DOCUMENTS

DE 4008642 A1 * 11/1990

(Continued)

OTHER PUBLICATIONS

International Search Report dated May 2, 2002, for application serial No. PCT/GB02/00356.

*Primary Examiner*—Jennifer H Gay
(74) *Attorney, Agent, or Firm*—Patterson & Sheridan, LLP

(57) ABSTRACT

Apparatus (9) for radially expanding an expandable member, the apparatus including a plurality of radially moveable fingers (22). The radially moveable fingers (22) can move between two positions; in a first position, the moveable fingers (22) are radially extended to a form a cone to facilitate radial expansion of the expandable member; in the second position, one or more of the radially movable fingers (22) can move radially inward so that restrictions in the path of the apparatus can be by-passed.

28 Claims, 7 Drawing Sheets

U.S. PATENT DOCUMENTS

| | | | | |
|---|---|---|---|---|
| 5,348,091 | A * | 9/1994 | Tchakarov et al. | 166/217 |
| 6,629,568 | B2 * | 10/2003 | Post et al. | 166/382 |
| 7,086,477 | B2 * | 8/2006 | Duggan | 166/380 |
| 2002/0144815 | A1 * | 10/2002 | Van Drentham-Susman et al. | 166/241.1 |
| 2004/0045720 | A1 * | 3/2004 | Duggan | 166/384 |
| 2004/0177953 | A1 * | 9/2004 | Wubben | 166/207 |

FOREIGN PATENT DOCUMENTS

| | | |
|---|---|---|
| FR | 2 595 439 | 9/1987 |
| WO | WO 00/37773 | 6/2000 |

* cited by examiner

EXPANDER DEVICE

CROSS-REFERENCE TO RELATED APPLICATIONS

This application claims benefit of PCT International application number PCT/GB02/00356 filed on Jan. 28, 2002, entitled "Expander Device", which claims benefit of British application serial number 0102021.3, filed on Jan. 26, 2001.

The present invention relates to apparatus that is particularly suited for radially expanding expandable members, such as liners, casings, tubulars and the like.

The present invention relates to apparatus that is particularly suited for radially expanding expandable members, such as liners, casings, tubulars and the like.

DESCRIPTION OF THE RELATED ART

It is known to use an expander device to expand at least a portion of an expandable member. Expandable members are typically of a ductile material so that they can undergo plastic and/or elastic deformation using an expander device. Expandable members can include liner, casing, drill pipe and other tubulars. Use of the term "expandable member" herein will be understood as being a reference to any one of these and other variants that are capable of being radially expanded by application of a radial expansion force, generally applied by the expander device, such as a cone. An expandable member is typically used within a borehole either to complete an uncased portion of a borehole, or to repair a damaged portion of a pre-installed liner or casing, for example.

The initial outer diameter (OD) of the expandable member is typically less than the inner diameter (ID) of the borehole, or a pre-installed portion of liner, so that the expandable member can be run into the borehole. An expander device can then be forced through the expandable member, and at least a portion of the expander device has an OD that is typically the same as, or slightly less than, the ID of the uncased borehole or previously installed liner. Thus, as the expander device passes through the expandable member, the OD of the expandable member is increased so that an outer surface of the expandable member is pressed against an inner wall of the uncased borehole, or the inner surface of the pre-installed liner.

Prior art expander devices are typically of a hard material, such as tungsten carbide, and are typically of a solid construction, for example a solid cone. As the expander device (e.g. a cone) is pushed or pulled through the expandable member, it can become stuck due to, for example, immovable portions of the inner wall of the uncased borehole that protrude inwards into the path of the expander device.

In such a case, the travel of the expander device may be restricted by the inward protrusion, and as a result, the expansion process cannot be completed, as the device becomes stuck at the protrusion.

When the expander device becomes stuck, it is necessary to retrieve the device from the borehole, typically by a fishing operation. Fishing operations generally require the expander device to be detached from a drill string or the like that is used to push or pull the expander device through the expandable member. Once the expander device has been detached, the drill string can be removed from the borehole, thus leaving the expander device therein. Clearly, the expander device must also be removed from the borehole to allow the recovery of hydrocarbons therefrom.

A typical fishing operation may involve the use of a tungsten carbide wash over-mill that is attached to an end of a drill string. The wash over-mill is rotated with the drill string, and the mill is inserted into the borehole to engage the obstruction and cut it away at its outer edges. However, as the wash over-mill cutters are generally made from the same material as the expander cone, they wear quickly and so this type of fishing operation is problematic.

Although other types of conventional fishing operations may be used, they all have a number of disadvantages. If the expander device does become stuck, the drill string used to push or pull it must be fully removed from the borehole, once the expander device has been detached. Boreholes can be many kilometres in length, and removal of the string in such cases is a very time consuming operation.

Thereafter, the stuck expander device must be retrieved using a conventional fishing operation. Having retrieved the expander device, a new device is attached to the end of the drill string, which is then lowered into the borehole to allow the expansion of the expandable member to continue. It may also be necessary to remove the obstruction (e.g. by using a wash over-mill) before the expansion process can continue.

This process results in a long rig downtime which can be very expensive due to the high costs involved, particularly on offshore rigs.

BRIEF SUMMARY OF THE INVENTION

According to a first aspect of the present invention, there is provided apparatus for expanding an expandable member, the apparatus comprising a first member, one or more radially movable portions, a second member, and force isolating means acting between the first and second members.

The first member typically comprises a housing. The housing may comprise a cylindrical member with a blind bore. The isolating means is typically coupled between a first end of the second member and the blind end of the bore. Alternatively, the isolating means is coupled between a lower face of the first member, and a face provided on the second member.

The second member typically comprises a shaft having a cone that bears against the radially movable portions (typically fingers pivotally mounted on the first member). The shaft and cone typically move axially with respect to the first member in and out of engagement with the radially movable portions (e.g. the fingers).

A second end of the second member is typically provided with attachment means for attaching the apparatus to a drill string or the like. The attachment means may comprise any conventional means such as screw threads (e.g. box and/or pin connections) or the like.

The fingers are typically coupled to the first member so that they can move in a radial and/or axial direction. Thus, the fingers can expand or contract to adjust an outer diameter of the apparatus. Typically, the fingers are held in a radially expanded position by the cone on the second member moving axially with respect to the first member to a first position in which the spring is contracted. In that first position, an outer surface of the cone abuts against an inner surface of the fingers and prevents them from moving radially inward. However, solid protrusions in the path of the fingers cause the force in the axial direction applied to the second member to extend the spring where the axial force exceeds the force of the spring. As the spring extends, the second member moves axially under the axial pulling force, and the cone moves to a second position that allows the fingers to move radially inward to bypass the restriction. As the restriction is passed, the axial pulling force drops below the biasing force of the spring as the force that is retarding the apparatus is overcome, the spring contracts and the second member moves into engagement with the fingers causing them to move radially outward to the radially expanded position. Additionally, the engagement of the fingers with the restriction can cause them to move inwards against the cone thereby moving it to the second position in which the spring is extended. In this way, if the apparatus encounters a restriction or the like, the fingers can retract until the apparatus has passed the restriction and then expand once passed.

By selecting the strength of the spring, the apparatus can be programmed to move the fingers at a given axial force that is typically greater than the force used to push or pull the apparatus. The given axial force can take into account the retarding force applied to the second member due to the obstruction.

The fingers are typically pivotally coupled to the first member using a pivot, such as a pivot pin, hinge or the like. Optionally, a biasing means may be provided to bias the fingers radially outward. The biasing means may comprise a torsion spring that is positioned at the pivot.

An outer face of the fingers typically defines a cone. The outer faces of the fingers are typically angled so that the cone formed thereby faces in the direction of travel of the apparatus. Thus, as the apparatus is moved in the direction of travel, the outer faces engage an inner wall of the expandable member or the like to expand the expandable member.

Optionally, the outer faces may include a second sloping face that is angled so that the apparatus can expand the inner diameter of the tubular when moved in the opposite direction to the normal direction of travel. In this embodiment, there is provided a double-sided cone that can be used in either direction of travel to expand the expandable member.

The cone of the second member typically comprises an enlarged diameter portion. The enlarged diameter portion is preferably located so that it is aligned on the axis of the apparatus with the fingers. The enlarged diameter portion is provided with an outer profile that allows the fingers to move inwards when the second member is moved axially within the first member. Thus, the fingers can contract to allow the apparatus to pass restrictions or obstructions. An inner face of the fingers is typically provided with a corresponding profile.

The outer profile typically comprises a flat portion extending in the axial direction, and a sloping portion. The profile on the inner face of the fingers typically comprises a flat portion extending in the axial direction, and a sloping portion. The sloping portion is preferably set at a shallow angle. In use, the flat portion and the sloping portion provided on the enlarged diameter portion engage respectively with the flat portion and the sloping portion provided on the inner face of the fingers. Thus, the second member supports the fingers in the radially expanded position during the expansion process. When the apparatus encounters a restriction or obstruction, the second member (and the enlarged diameter portion thereof) moves in the direction of travel or load. As the enlarged diameter portion moves axially out of engagement with the inner face of the fingers, at least the sloping portions of the respective profiles on the enlarged diameter portion and the inner face of the fingers disengage. This allows the fingers to contract as they can move radially inward into the space created by axial movement of the enlarged diameter portion.

According to a second aspect of the present invention, there is provided apparatus for expanding an expandable member, the apparatus comprising a body, one or more radially movable portions, and force isolating means acting between the body and the or each radially moveable portion.

The force isolating means typically provides a biasing force to the or each radially moveable portion. The force required to move the or each radially moveable portion inwards is typically greater than the biasing force of the force isolating means.

Force applied to the body is typically transmitted to the or each radially moveable portion through the isolating means, and the radial position of the or each radially movable portion is typically at least partially controlled by the biasing force of the force isolating means. Force applied to the body can be isolated from the or each radially moveable portion by the force isolating means.

The isolating means typically comprises a resilient member that allows relative movement between the body and the or each radially moveable portion, preferably in an axial direction. The resilient member may comprise a spring. The resilient member typically has a biasing force that is greater than a maximum load that will be applied to the apparatus. Thus, when the maximum load is reached and exceeded, the biasing force of the resilient member is overcome, and the resilient member deforms (e.g. extends or contracts) in the direction of the load.

Alternatively, the isolating means comprises a fluid chamber that is in communication with the or each radially moveable portion. The fluid chamber is preferably in fluid communication with a spring means. The spring means typically comprises a first chamber, a floating piston in communication with the first chamber, and a second chamber in communication with the piston. The first chamber typically contains fluid and is in fluid communication with the fluid chamber that is in communication with the or each radially moveable portion. The second chamber typically includes a spring. The spring may be mechanical, hydraulic, pneumatic or the like.

In this embodiment, as the radially moveable portions are forced inward due to a restriction, they act on the fluid in the fluid chamber, forcing the fluid into the first chamber. The displacement of fluid causes the piston to compress the spring in the second chamber and this allows the radially moveable portions to move inwards, thus passing the restriction. Once the restriction has been passed, the spring extends forcing fluid in the first chamber to be transferred to the fluid chambers, thus forcing the radially moveable portions outwards.

The biasing force of the force isolating means is typically provided by the spring. Optionally, the biasing force of the spring may be varied.

In an alternative embodiment, the isolating means comprises a hydraulic spring. The hydraulic spring typically comprises an inflatable element that is in fluid communication with a fluid chamber. The fluid chamber is typically filled with a fluid (e.g. oil) that is typically incompressible. The fluid in the fluid chamber acts on a floating piston that is located in a second chamber. The second chamber is typically filled with a fluid, preferably gas.

In this embodiment, as the radially moveable portions are forced inwards due to a restriction, they act on the fluid in the inflatable element, forcing fluid into the fluid chamber. The displacement of fluid into the fluid chamber acts on the piston, causing it to compress the fluid in the second chamber. This allows the radially moveable portions to move inwards, thus passing the restriction. Once the restriction has been passed, the fluid in the second chamber expands, forcing the piston to act on the fluid in the fluid chamber, the fluid typically being transferred to the inflatable element, thus forcing the radially moveable portions outwards.

The biasing force of the force isolating means is typically provided by the fluid in the second chamber. Optionally, the biasing force can be varied, typically by varying the amount of fluid in the second chamber.

The body may comprise a cylindrical member, and the or each radially moveable portion is typically pivotably mounted to the body.

The apparatus optionally includes a second member that typically comprises a shaft. The shaft typically houses at least a portion of the isolating means. In one embodiment, the shaft houses the fluid chamber that is in communication with the or each radially moveable portion, and the spring means. In an alternative embodiment, the shaft houses a hydraulic spring.

A second end of the shaft is typically provided with attachment means for attaching the apparatus to a drill string or the like, although the attachment means may be provided on the body. The attachment means may comprise any conventional means such as screw threads (e.g. box and/or pin connections) or the like.

The or each radially moveable portion typically comprises one or more fingers. The or each finger is typically coupled to the body so that they can move in a radial and/or axial direction. Thus, the or each finger can expand or contract to adjust an outer diameter of the apparatus. Typically, the or each finger is held in a radially expanded position by the fluid in the fluid chamber or the inflatable element. In this position, the fluid in the inflatable element or the fluid chamber abuts against an inner surface of the or each finger and prevents them from moving radially inward. However, the fingers can move radially inward against the biasing force of the hydraulic spring or the spring means, provided that the force acting on the fingers produced by engagement with the restriction is sufficient to overcome the biasing force.

The or each finger is typically pivotally coupled to the housing using a pivot, such as a pivot pin, hinge or the like. Optionally, a biasing means may be provided to bias the fingers radially outward. The biasing means may comprise a torsion spring that is positioned at the pivot.

An outer face of the or each finger typically defines a cone. The outer faces of the or each finger are typically angled so that the cone formed thereby faces in the direction of travel of the apparatus. Thus, as the apparatus is moved in the direction of travel, the outer faces engage an inner wall of the expandable member or the like to expand the expandable member.

Optionally, the outer faces may include a second sloping face that is angled so that the apparatus can expand the inner diameter of the tubular when moved in the opposite direction to the normal direction of travel. In this embodiment, there is provided a double-sided cone that can be used in either direction of travel to expand the expandable member.

The expandable member can be any tubular member, such as casing, liner, drill pipe etc, and other such downhole tubulars.

BRIEF DESCRIPTION OF THE SEVERAL VIEWS OF THE DRAWINGS

Embodiments of the present invention shall now be described, by way of example only, with reference to the accompanying drawings, in which.

DETAILED DESCRIPTION OF THE INVENTION

Figure 1:
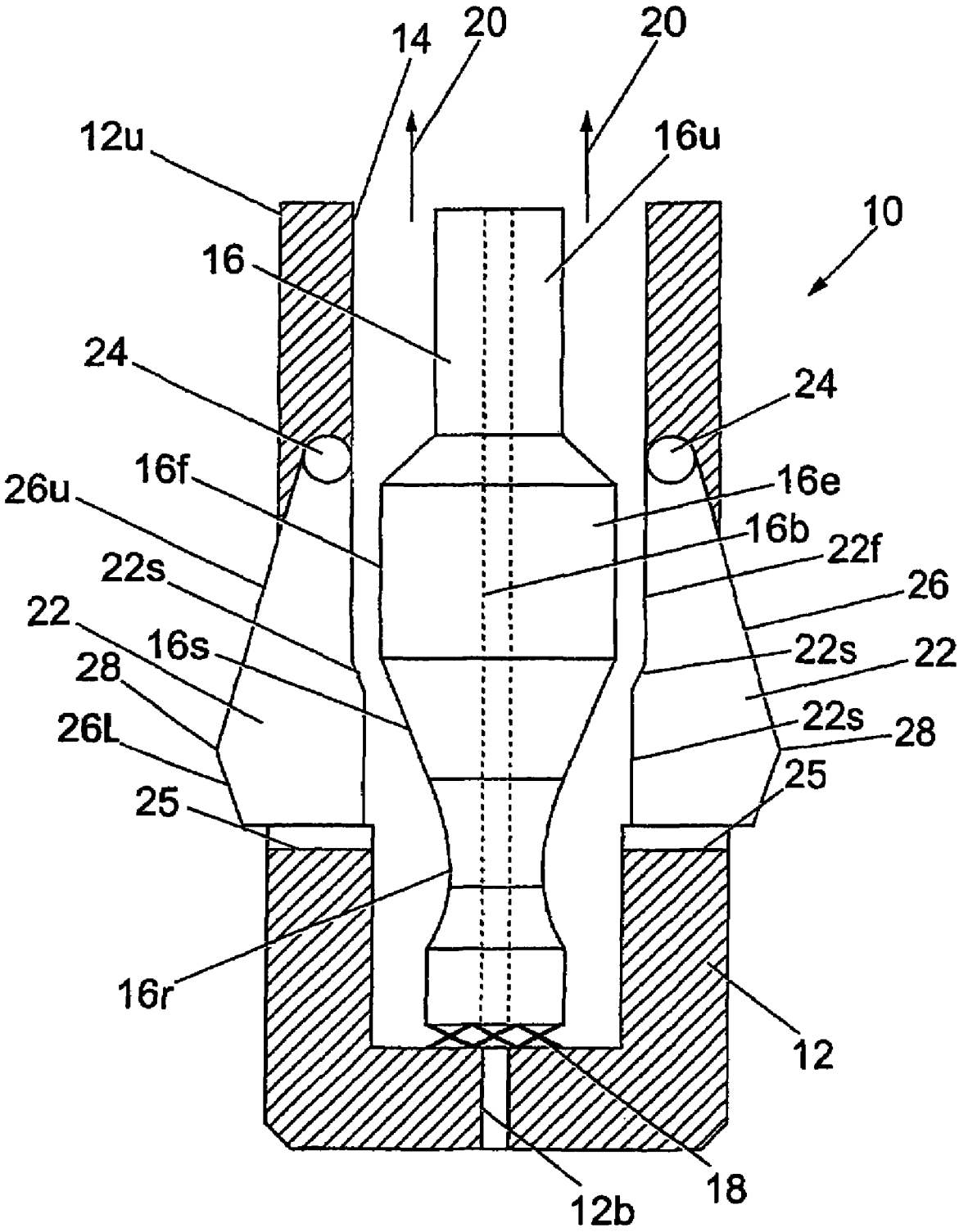
FIG. 1 is a cross-sectional elevation of a first embodiment of apparatus for radially expanding an expandable member.

Referring to the drawings, FIG. 1 shows a part cross-sectional elevation of an exemplary embodiment of apparatus, generally designated 10, for expanding an expandable member such as liners, casings, drill pipe and other such downhole tubulars. It should be noted that the terms "upper" and "lower" will be used herein with reference to the orientation of the apparatus 10 as shown in FIG. 1, but this is arbitrary.

The expandable member may comprise any tubular, such as drill pipe, liner, casing or the like and is typically of a ductile material so that it can be radially expanded. The radial expansion of the expandable member typically causes the member to undergo plastic and/or elastic deformation to increase its inner and outer diameters.

Apparatus 10 includes a housing 12 that is typically cylindrical, although other shapes and configurations are also contemplated. Housing 12 is provided with a blind bore 14.

A shaft 16 is located within the bore 14 and is attached to the housing 12 via a resilient member, which in this embodiment comprises a spring 18, provided at the (blind) lower end of the bore 14. Any member that has resilient properties, i.e. it can regain its original shape and configuration after being stretched, compressed or otherwise deformed, can be used. The purpose of the resilient member 18 is to absorb an axial pulling force (represented by arrows 20 in FIG. 1) applied to the shaft 16 during expansion, and to isolate that axial force from a radial expansion force that is applied to a plurality of cone segments or fingers 22, as will be described. Housing 12 has an upper portion 12*u*.

The biasing force of the resilient member 18 (e.g. the spring) is preferably rated at a higher level than the anticipated maximum pulling force or load 20 applied to the apparatus 10 in the axial direction. Thus, in normal use, the resilient member 18 will not be fully extended, provided that the maximum load 20 does not exceed the biasing force of the spring 18. However, when the axial load 20 exceeds the biasing force of the spring 18 (i.e. the anticipated maximum pulling force in the axial direction overcomes the biasing force of spring 18), the spring 18 extends (FIG. 2), as will be described.

Shaft 16 is provided with attachment means (not shown) at an upper portion 16*u* that is used to couple the apparatus 10 to a drill string or the like. The attachment means may comprise any conventional coupling, such as screw threads (e.g. a pin and/or box connection) or the like.

Shaft 16 is also provided with a central bore 16*b* for the passage of fluids therethrough. Similarly, housing 12 is provided with a bore 12*b* at the lower end thereof so that fluid can pass from above to below the apparatus 10, or vice versa. This facilitates the circulation of fluids within the borehole, both when the apparatus 10 is being run in, and also whilst it is in use. Optionally, fluid pressure may be used to propel the apparatus 10, as will be described.

The shaft 16 is further provided with a reduced diameter portion 16*r* that facilitates inward movement of the fingers 22, as will be described.

The plurality of cone segments or fingers 22 (only two shown in FIG. 1) are pivotally coupled to the housing 12 around its circumference, using, for example, a pivot pin 24 or the like. It is preferred that the fingers 22 are capable of movement in a radial direction so that they can assume either a radially expanded configuration (shown in FIG. 1), or a retracted configuration (shown in FIG. 2). Optionally, the fingers 22 may also be capable of movement in an axial direction.

In the radially expanded configuration, as shown in FIG. 1, the fingers 22 are extended so that they form an outer diameter that approximates the final (expanded) inner diameter of the expandable member, to effect radial expansion thereof. In the retracted configuration shown in FIG. 2, the fingers 22 assume an outer diameter that is less than the nominal (unexpanded) inner diameter of the expandable member, and typically less than an outer diameter of the housing 12, although this is not essential. Thus, when in the expanded configuration, the fingers 22 expand the expandable member. In the retracted configuration, the fingers 22 can bypass restrictions within the expandable member or restrictions that protrude into the path of the apparatus 10 from, for example, the surrounding formation, that would arrest the travel of the apparatus 10.

A plurality of windows or slots 25 are provided in the housing 12 to accommodate the radial movement of the fingers 22. The windows 25 may also be dimensioned to allow for movement of the fingers 22 in the axial direction also.

The shaft 16 is provided with an enlarged diameter portion 16*e* that has an outer profile corresponding to an inner profile of the fingers 22. In particular, the outer profile of the enlarged portion 16*e* has a flat portion 16*f*, and a sloping portion, 16*s*. Correspondingly, the inner surface of the fingers 22 has a flat portion 22*f*, and a sloping portion 22*s*.

In normal use, the respective portions 16*f*, 22*f*, 16*s*, 22*s* engage so that the shaft 16 prevents the fingers 22 from moving radially inward, and can also provide support to the fingers 22 during the expansion process. It is preferred, but not essential, that the angle of the sloping portions 16*s*, 22*s* is relatively shallow. The shallow angle provides a larger contact area for the compressive force applied through the fingers 22 to the shaft 16 at an angle perpendicular to the sloping portion 22*s*, as movement of the fingers 22 past the obstruction will push the fingers 22 radially inward. To overcome this compressive force, a torsion spring or any other biasing means can be used, for example at the pivots 24, to bias the fingers radially outward. The biasing force of the torsion spring would be at least equal to the normal compressive force applied to the fingers 22 when an obstruction is encountered.

It should be noted that the angle of the face 16*s* to the axis of the apparatus 10 can be adjusted to provide a gearing effect. With the surface 16*s* at a shallow angle that is close to parallel to the axis of the shaft 16, the force required to move the shaft 16 and extend the spring 18 is high; whereas with the surface 16*s* at a steep angle near perpendicular to the axis, the shaft 16 can be induced to move and extend the spring 18 under a fairly small force applied through the fingers 22.

Figure 2:
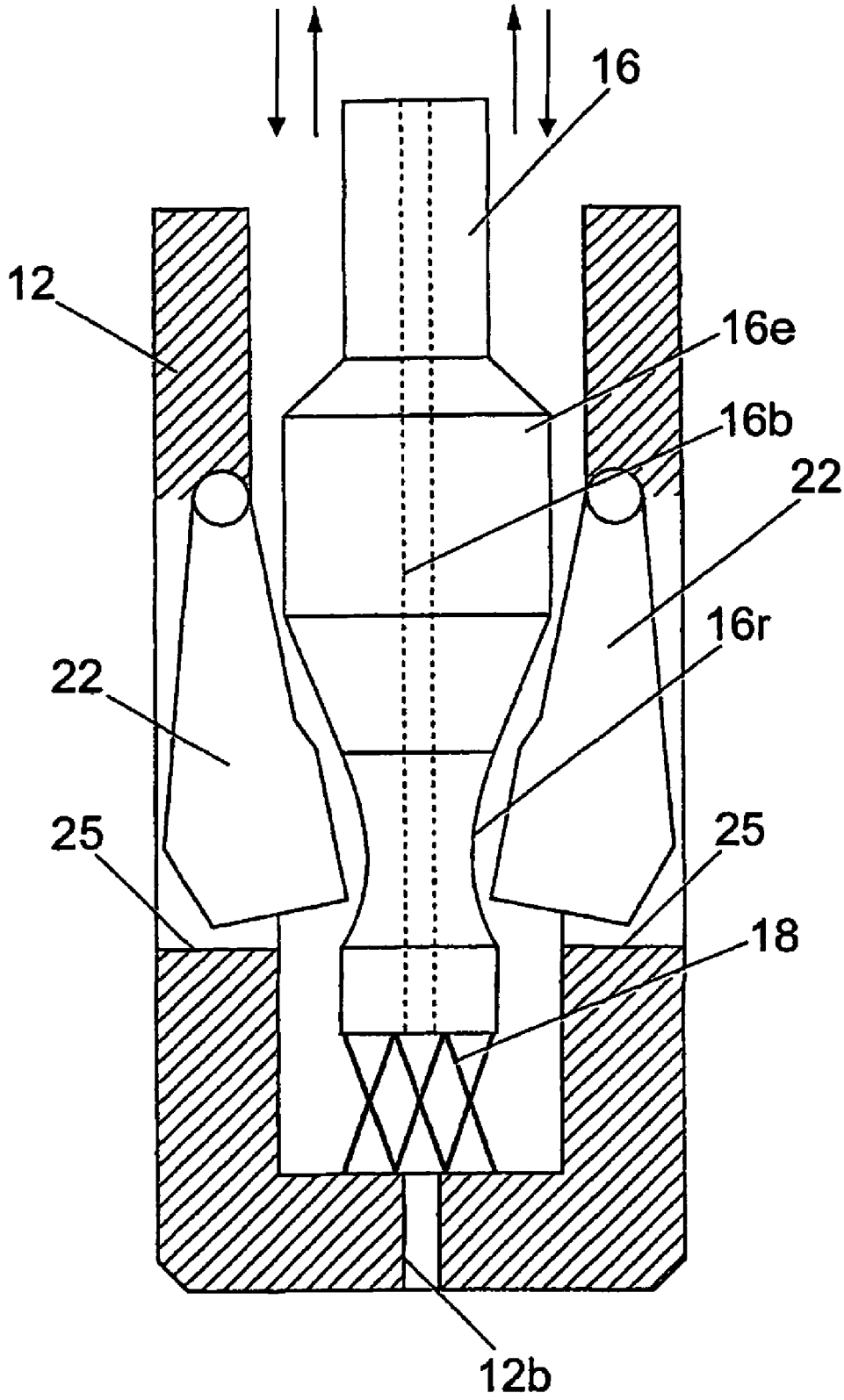
FIG. 2 is a view of the apparatus of FIG. 1 in a contracted configuration.

The expandable member is expanded by an outer face 26 of the fingers 22 that together with an upper portion 26*u* form an expansion cone made up from the protrusion, and the increased force will be greater than the force required to overcome the biasing force of the spring 18. The expandable member has a lower end 26L. As the spring 18 expands, the shaft 16 and in particular the enlarged portion 16*e* is moved upwardly in the axial direction as shown in FIG. 2.

In the FIG. 1 embodiment, each finger 22 has a lower portion 261 that tapers from the widest point 28 radially inwards towards the other end of the fingers. Thus, faces 27 on the lower portion 261 form a second expansion cone that can be used to expand the expandable member in the reverse direction (that is the direction opposite to the normal direction of travel). It should be noted that the provision of the second expansion cone formed by the faces 27 on the lower portion 261 is optional.

The widest point 28 is created at the junction between the upper and lower outer faces 26, 27.

In use, the apparatus 10 is attached to a drill string or the like using the attachment means typically located at the upper end 16*u* of the shaft 16.

An expandable member that is to be located in the borehole and then expanded can be positioned on top of the apparatus 10. That is, the expandable member can be rested on the upper face 26*u* of the fingers 22 whilst the drill string is inserted into the borehole. The expandable member is then anchored into place, for example using an anchoring device (e.g. a packer) at the top or bottom of the expandable member, depending on the direction of propulsion of the apparatus 10.

The apparatus 10 is generally pulled up through the expandable member using the drill string so that the upper faces 26*u* on the fingers 22 radially expands the inner surface of the expandable member. In this case, the expandable member would typically be anchored at a lower end thereof. The expandable member is preferably expanded sufficiently so that the outer surface thereof presses against the formation of the borehole, or the pre-installed portion of expandable member, casing etc.

Referring to FIG. 2, if during the expansion process, the apparatus 10 becomes stuck, for example due to a solid protrusion on or in the expandable member into the path of the apparatus 10, or a solid protrusion in the surrounding formation that extends into the path of the apparatus 10, the spring 18 extends in the axial direction because the force that is used to pull the apparatus 10 through the expandable member increases, the apparatus 10 stops moving at the protrusion, and the increased force will be greater than the force required to overcome the biasing force of the spring 18. As the spring 18 expands, the shaft 16 and in particular the enlarged portion 16*e* is moved upwardly in the axial direction as shown in FIG. 2.

As shaft 16 moves upwards and the housing 12 is arrested at the protrusion, the fingers 22 are no longer supported by the enlarged diameter portion 16*e* and can move radially inward. This inward movement of at least one of the fingers 22 can allow the apparatus 10 to bypass the restriction. This process can be aided if the fingers 22 are capable of some axial movement in the opposite direction to the movement of the shaft 16. The axial movement can be aided by providing elongated slots that extend in the axial direction at the pivots 24. When the fingers 22 encounter a restriction at the expansion point 28, the axial pulling force 20 will tend to pull the apparatus 10 upwardly. If the pivot pins 24 are located in axial slots, the fingers 22 can move axially downwards in the slots relative to the housing 12, further separating the enlarged diameter portion 16*e* and the fingers 22 and allowing the fingers 22 to move radially inward.

As the protrusion is passed, the spring 18 contracts because it has a higher biasing force than the normal pulling force 20 applied to the apparatus 10, and the fingers 22 move radially outward to the position shown in FIG. 1 due to the engagement of the enlarged diameter portion 16*e* with the fingers 22, and/or the biasing force applied to the fingers 22 (e.g. at the pivot pins 24).

Thus, as the fingers 22 can contract by moving radially inwards (and optionally axially), the apparatus 10 does not become permanently stuck, thereby obviating having to retrieve the apparatus 10 from the borehole. This provides an advantage in that no rig time is lost in having to perform a fishing operation to retrieve the stuck expander device. Also, the apparatus 10 resets itself back into expansion mode due to the biasing force of the spring 18. Thus, it can bypass any number of restrictions within the borehole without having to be retrieved therefrom and manually reset.

It should be noted that reversing the direction of travel of the apparatus 10 could aid in freeing it, as the fingers 22 will be pushed radially inward due to contact with the restriction.

Hydraulic or other types of fluid pressure may be used to propel the apparatus 10. In this particular embodiment, the apparatus 10 would be turned upside down with respect to the orientation shown in FIGS. 1 and 2. Fluid pressure can then be applied to the apparatus 10, at least a portion of which preferably acts directly on the end of shaft 16, typically via a throughbore 12*b* in housing 12. The bore 16*b* through the shaft 16 is generally not required for this particular embodiment. However, the bore 16*b* can be provided with a restriction (e.g. a blind bore) so that fluid pressure in the bore 16*b* can be contained to aid movement of the shaft 16.

It will be appreciated that bore 12*b* can be made larger or smaller to adjust the pressure that is applied to the end of the shaft 16. The end of the shaft 16 could be provided with a flared end (optionally with seals) that engages bore 14 of the housing 12.

Fluid pressure would be applied to housing 12, and a portion of this pressure would act directly on the shaft 16 via bore 12*b*. The contact between the upper faces 26*u* (which would be lower faces with the apparatus 10 turned upside down) with the expandable member that is to be expanded would create a seal for the fluid pressure. The apparatus 10 could thus be used to expand the expandable member from the top down. This is advantageous, as no rig would be required to push or pull the apparatus 10 (only fluid pressure), but the apparatus 10 would generally need to be retrieved from the borehole once the expandable member has been expanded.

As the apparatus 10 is propelled through the expandable member using fluid pressure, the upper faces 26*u* of the fingers 22 form an expansion cone that will radially expand the expandable member. As with the previous embodiment, if during the expansion process the apparatus 10 becomes stuck, the spring 18 extends in the axial direction because the fluid pressure applied to the shaft 16 increases, but the apparatus 10 stops moving at the protrusion, and the increased force will be greater than the force required to overcome the biasing force of the spring 18. The spring 18 expands, and the shaft 16, in particular the enlarged diameter portion 16*e*, is moved upwardly in the axial direction. The upward movement of shaft 16 allows the fingers 22 to move inward as they are no longer supported by the enlarged diameter portion 16*e*. This inward movement of at least one of the fingers 22 can allow the apparatus 10 to bypass the restriction.

Where the bore 16*b* is provided with a restriction, the build up of fluid pressure caused by the arrest in the travel of the apparatus 10 will aid in moving the shaft 16 against the bias force of spring 18, so that the enlarged portion 16*e* moves out of contact with the fingers 22, allowing one or more fingers 22 to move radially inward.

As the protrusion is passed, the spring 18 contracts because it has a higher biasing force than the force of the fluid pressure applied to the apparatus 10, and the fingers 22 move radially outward due to the engagement of the enlarged diameter portion 16*e* with the fingers 22, and/or the biasing force applied to the fingers 22 (e.g. at the pivot pins 24).

Alternatively, the shaft 16 in this embodiment could be attached to the housing 12 above the level of the fingers 22, for example using a spring. The spring would typically be a compressive spring where in its normal state the spring is extended, but can be compressed.

As fluid pressure is applied to the bottom of shaft 16 and/or the housing 12, the apparatus is moved through the expandable member to radially expand the expandable member (typically using upper faces 26*u*). When the apparatus meets a restriction in its path, the travel of the apparatus is arrested at which point the fluid pressure acts on shaft 16 thereby compressing the spring. The compression of the spring allows the shaft 16 to move axially and thus the enlarged portion 16*e* moves out of contact with the fingers 22 allowing them to move radially inwards and thus by-pass the restriction. Once the restriction is passed, the spring extends to its normal configuration and expansion of the expandable member continues.

It will be appreciated that the force that normally biases the spring to move the shaft 16 away from the housing can be selected to provide a pre-tensioning means, as described below.

It should be noted that as the fingers 22 are independently attached to the housing 12, partial collapse of the cone formed thereby is possible. This may result in, for example, an elliptical shape at the widest point 28.

Figure 3:
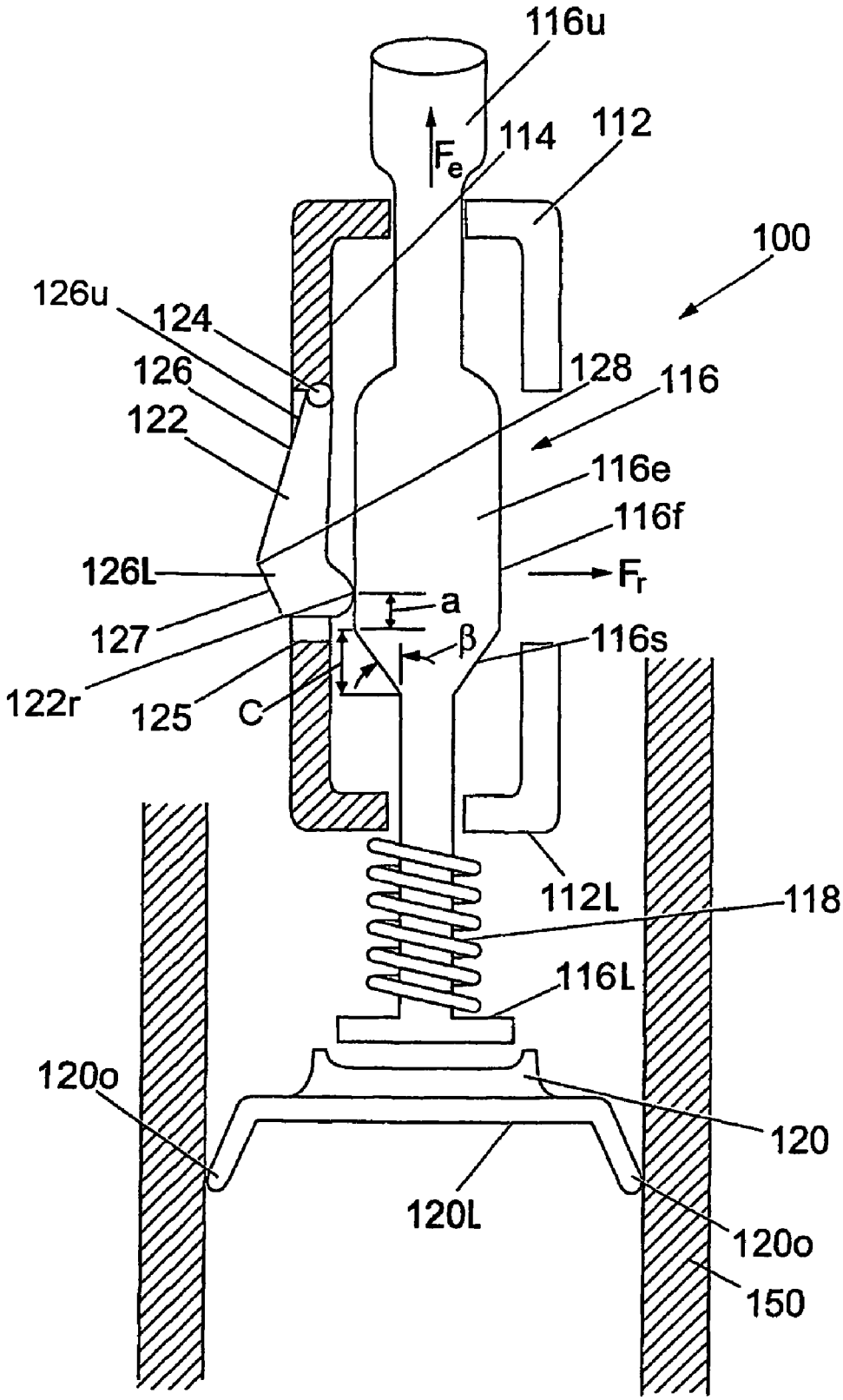
FIG. 3 is a cross-sectional elevation of a second embodiment of apparatus for radially expanding an expandable member.
Figure 4:
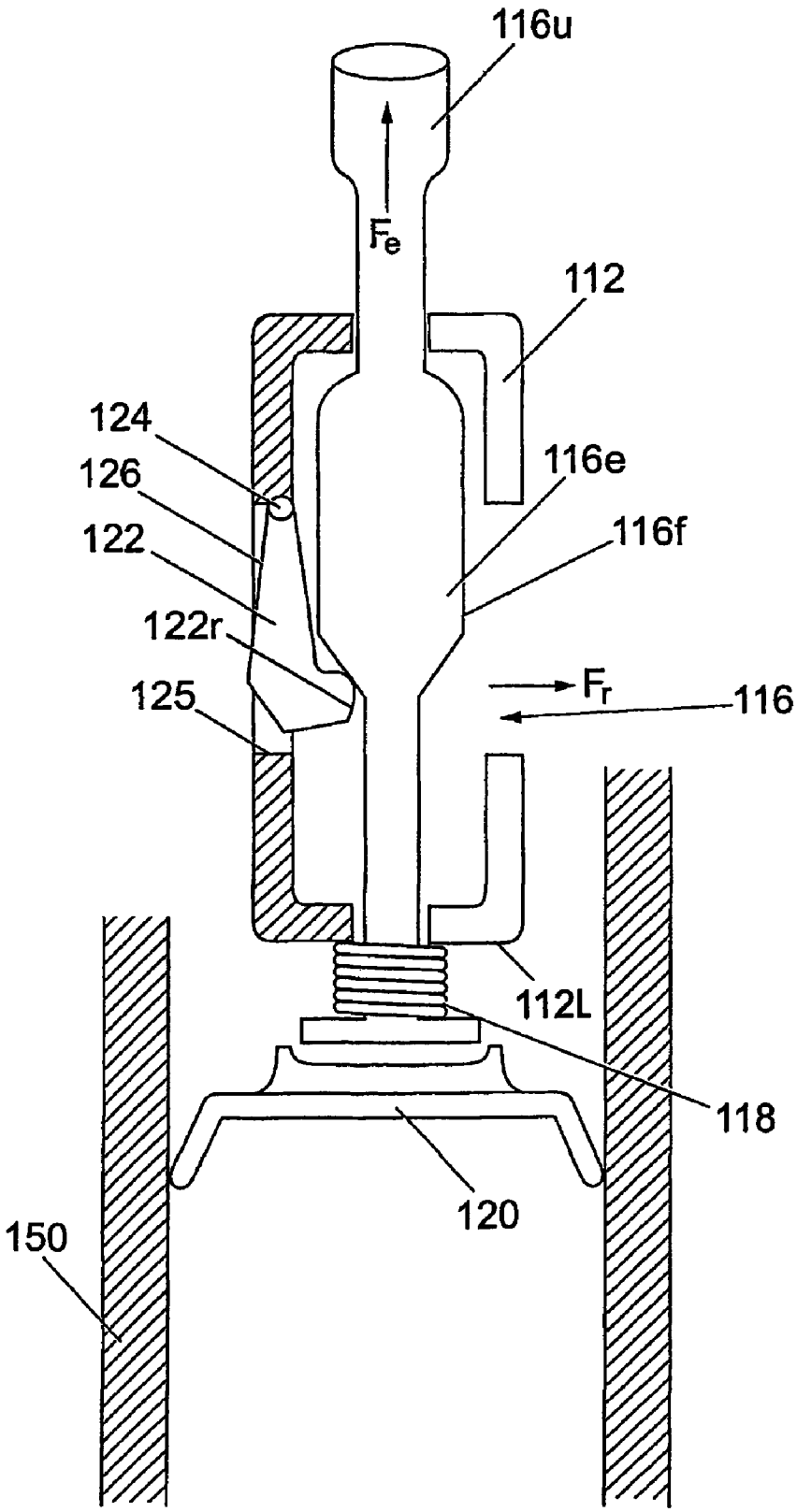
FIG. 4 is a view of the apparatus of FIG. 3 in a contracted configuration.

FIGS. 3 and 4 show an alternative embodiment of apparatus according to the present invention, generally designated 100. Apparatus 100 is similar to apparatus 10 (FIGS. 1 and 2) and includes a housing 112 (shown in part cross-section) that is typically cylindrical, although other shapes and configurations are also contemplated. The housing 112 is provided with an internal cavity or bore 114 in which a shaft 116 is partially located.

An upper portion 116*u* of the shaft 116 is typically provided with conventional coupling means (e.g. screw threads) so that the apparatus 100 can be coupled to a drill string, coiled tubing string, wireline or the like. Thus, the apparatus 100 can be pulled through an expandable member 150 that is to be expanded.

Shaft 116 is capable of longitudinal movement within the cavity 114 relative to housing 112 and is biased to the position shown in FIG. 3 by a resilient member, which in this embodiment comprises a spring 118. Spring 118 is located below the housing 112, typically between a lower face 112*l* of the housing 112 and a lower face 116*l* of the shaft 116. It should be noted that spring 118 is merely exemplary, and any member that has resilient properties, i.e. it can regain its original shape and configuration after being stretched, compressed or otherwise deformed, can be used. In the embodiment shown in FIGS. 3 and 4, the spring 118 is typically normally extended.

As with the previous-embodiment, the purpose of the spring 118 is to absorb an axial pulling or propulsive force applied to the shaft 116 during the radial expansion process (as described below), and to isolate that axial pulling or propulsive force from a radial expansion force that is applied to a plurality of cone segments or fingers 122, as will be described.

The biasing force of the spring 118 is preferably rated at a higher level than the anticipated maximum 16 pulling or propulsive force applied to the apparatus 100 in the axial direction. Thus, in-normal use, the spring 118 is typically fully extended, provided that the maximum pulling or propulsive force does not exceed the biasing force of the spring 118. However, when the axial pulling or propulsive force exceeds the biasing force of the spring 118 (i.e. the anticipated maximum pulling or pushing force in the axial direction overcomes the biasing force of spring 118), the spring 118 contracts (FIG. 4), as will be described.

The embodiment shown in FIGS. 3 and 4 can be propelled through the casing using hydraulic or other fluid pressure. An optional stop 120 is provided that is engageable with a lower end of the shaft 116. Fluid acts on a lower surface 120*l* of the stop 120 and thus propels the apparatus 100 upwardly, providing that the force of fluid pressure is sufficient. The stop 120 can be provided with sealing means that seal between outer surfaces 120*o* of the stop 120 and the inner surface of the expandable member 150 that is to be radially expanded.

In this particular embodiment, the shaft 116 and the optional stop 120 are not provided with throughbores (unlike the previous embodiment) although they may be if required. The throughbores could facilitate the circulation of fluids within the borehole, both when the apparatus 100 is being run in, and also whilst it is in use.

The plurality of cone segments or fingers 122 (only one shown in FIG. 1) are pivotally coupled to the housing 112 around its circumference, using, for example, a pivot pin 124 or the like. It is preferred that the fingers 122 are capable of movement in a radial direction so that they can assume either a radially expanded configuration (shown in FIG. 3), or a retracted configuration (shown in FIG. 4). Optionally, the fingers 122 may also be capable of movement in an axial direction.

In the radially expanded configuration, as shown in FIG. 3, the fingers 122 are extended so that they form an outer diameter that approximates the final (expanded) inner diameter of the expandable member 150, casing etc to effect radial expansion thereof. In the retracted configuration shown in FIG. 4, the fingers 122 assume an outer diameter that is less than the nominal (unexpanded) inner diameter of the expandable member 150, and typically less than an outer diameter of the housing 112, although this is not essential. Thus, when in the expanded configuration, the fingers 122 expand the expandable member 150. In the retracted configuration, the fingers 122 can bypass restrictions within the expandable member 150 or restrictions that protrude into the path of the apparatus 100 from, for example, the surrounding formation, that would arrest the travel of the apparatus 100.

A plurality of windows or slots 125 are provided in the housing 112 to accommodate the radial movement of the fingers 122. The windows 125 may also be dimensioned to allow for movement of the fingers 122 in the axial direction.

As with the previous embodiment, shaft 116 is provided with an enlarged diameter portion 116*e*. The enlarged diameter portion 116*e* has a flat portion 116*f*, and a sloping portion 116*s*. In this embodiment, the fingers 122 are provided with a rounded inner surface 122*r* that typically engages the flat surface 116*f* of the enlarged portion 116*e* during normal use (as shown in FIG. 3). Fingers 122 may have a similar inner profile to fingers 22.

In normal use, the rounded inner surface 122*r* engages the flat surface 116*f* so that the shaft 116 prevents the fingers 122 from moving radially inward, and can also provide support to the fingers 122 during the expansion process. As with the previous embodiment, a torsion spring or any other biasing means can be used, for example at the pivots 124, to bias the fingers 122 radially outward. The biasing force of the torsion spring would be at least equal to the normal compressive force applied to the fingers 122 when an obstruction is encountered.

The expandable member 150 is expanded by an outer face 126 of the fingers 122 that together with an upper portion 126*u* form an expansion cone made up from the individual fingers 122, each tapering towards the direction of travel from a widest point 128. When the fingers 122 are in the radially extended position, as shown in FIG. 3, the upper portions 126*u* of the faces 126 form a first expansion cone, the apex of which points in the direction of travel of the apparatus 100. It is preferred, but not essential, that the upper portions 126*u* of the outer faces 126 form a continuous surface to expand the expandable member 150 or the like across the entire inner circumference thereof.

In the FIG. 3 embodiment, each finger 122 has a lower portion 126*l* that tapers from the widest point 128 radially inwards towards the other end of the fingers. Thus, faces 127 on the lower portion 126*l* form a second expansion cone that can be used to expand the expandable member 150 in the reverse direction (that is the direction opposite to the normal direction of travel). It should be noted that the provision of the second expansion cone formed by the faces 127 on the lower portion 126*l* is optional.

The widest point 128 is created at the junction between the upper and lower outer faces 126, 127.

In use, the apparatus 100 may be attached to a drill string, coiled tubing string, wireline or the like. The expandable member 150 that is to be located in the borehole and then expanded can be positioned on top of the apparatus 100. That is, the expandable member 150 can be rested on the upper face 126*u* of the fingers 122 whilst the expandable member 150 or the like is inserted into the borehole. The expandable member 150 is then anchored into place, for example using an anchoring device (e.g. a packer) at the top or bottom of the expandable member 150, depending on the direction of motion of the apparatus 100.

The apparatus 100 is pulled or propelled upwardly through the expandable member 150 ("upwardly" being arbitrary and with respect to the orientation of the apparatus 100 in FIGS. 3 and 4) using a drill string or the like to pull the apparatus 100, or by applying fluid pressure to the lower surface 120*l* of the stop 120. The upper portions 126*u* on the fingers 122 radially expand the inner surface of the expandable member 150 as the apparatus 100 is pulled or propelled through the casing. In this case, the expandable member 150 would typically be anchored at or near a lower end thereof. The expandable member 150 is preferably expanded sufficiently so that the outer surface of the expandable member 150 presses against the formation of the borehole, or the pre-installed portion of liner, casing etc.

Referring to FIG. 4, if during the expansion process, the apparatus 100 becomes stuck, for example due to a solid protrusion on or in the expandable member 150 in the path of the apparatus 100, or a solid protrusion in the surrounding formation that extends into the path of the apparatus 100, the spring 118 contracts in the axial direction because the pulling or fluid force that is used to pull or propel the apparatus 100 through the expandable member 150 increases, the apparatus 100 stops moving at the protrusion, and the increased force will be greater than the force required to overcome the biasing force of the spring 118. As the spring 118 contracts, the shaft 116 and in particular the enlarged portion 116*e* is moved upwardly in the axial direction as shown in FIG. 4.

As shaft 116 moves upwards and the housing 112 is arrested at the protrusion, the fingers 122 are no longer supported by the enlarged diameter portion 116*e* and can move radially inward. This inward movement of at least one of the fingers 122 can allow the apparatus 100 to bypass the restriction. This process can be aided if the fingers 122 are capable of some axial movement in the opposite direction to the movement of the shaft 116. The axial movement can be aided by providing elongated slots that extend in the axial direction at the pivots 124. When the fingers 122 encounter a restriction at the widest point 128, the fluid propulsion will tend to push the apparatus 100 upwardly. If the pivot pins 124 are located in axial slots, the fingers 122 can move axially downwards in the slots relative to the housing 112, further separating the enlarged diameter portion 116*e* and the fingers 122 and allowing the fingers 122 to move radially inward.

As the protrusion is passed, the spring 118 expands because it has a higher biasing force than the normal pulling or propulsive force applied to the apparatus 100, and the fingers 122 move radially outward to the position shown in FIG. 3 due to the engagement of the enlarged diameter portion 116*e* with the fingers 122, and/or the biasing force applied to the fingers 122 (e.g. at the pivot pins 124).

Thus, as the fingers 122 can contract by moving radially inwards (and optionally axially), the apparatus 100 does not become permanently stuck, thereby obviating having to retrieve the apparatus 100 from the borehole. This provides an advantage in that no rig time is lost in having to perform a fishing operation to retrieve the stuck expander device. Also, the apparatus 100 resets itself back into expansion mode due to the biasing force of the spring 118. Thus, it can bypass any number of restrictions within the borehole without having to be retrieved therefrom and manually reset.

It should be noted that as the fingers 122 are independently attached to the housing 112, partial collapse of the cone formed thereby is possible. This may result in, for example, an elliptical shape at the widest point 128.

In this particular embodiment, setting weight on the shaft 116 from the drill string, coiled tubing string etc from above can aid in resetting the apparatus 100 and thus open up the fingers 122 to form the expansion cone.

Figure 5:
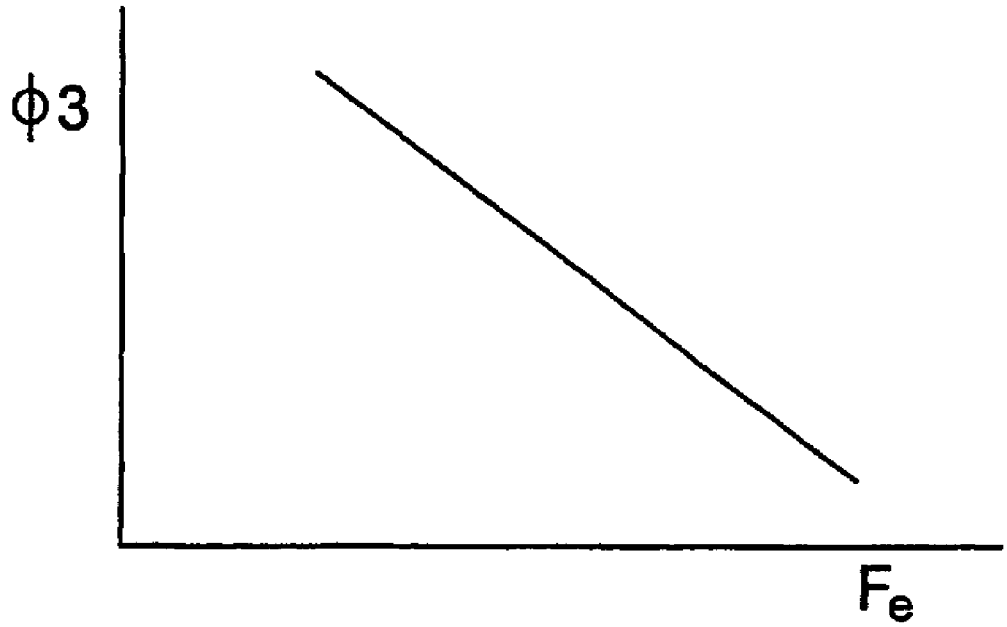
FIG. 5 is a graph showing a typical relationship between an expanding diameter of the apparatus of FIGS. 1 and 2 with the pulling force applied to the apparatus.

The axial pulling force, represented by $F_e$ in FIGS. 3 to 6, is typically directly related to the diameter of the apparatus 100 at the widest point 128 of the fingers 122. Referring to FIG. 5, there is shown the general relationship between the diameter at the widest point (represented in FIGS. 5 and 6 as $\phi$3) and the axial pulling force $F_e$. As can be seen from FIG. 5, the diameter at the widest point reduces linearly as the pulling force $F_e$ increases.

However, it is preferred that the apparatus 100 is provided with a means that prevents the fingers 122 from moving inward until a given value of pulling force $F_e$ is achieved or preferably exceeded.

Figure 6:
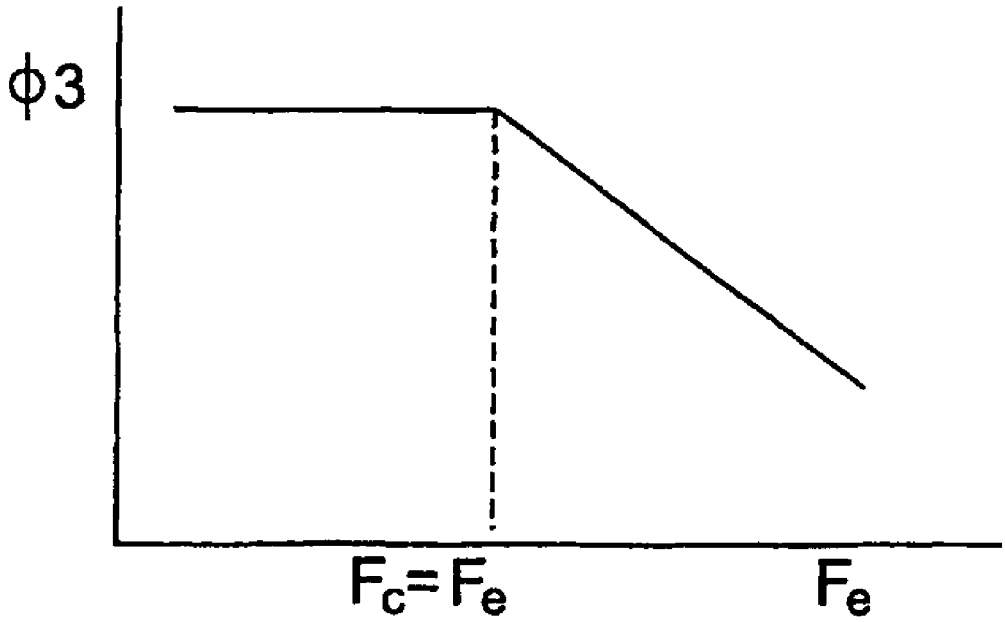
FIG. 6 is a graph showing a typical relationship between an expanding diameter of the apparatus of FIGS. 3 and 4 with the pulling force applied to the apparatus and/or where the apparatus of FIGS. 1 and 2 is provided with a pre-tensioning means.

FIG. 6 shows a pre-tensioning force $F_c$ that can be applied to the apparatus 100, where $F_c$ is typically greater than or equal to $F_e$. Thus, the pre-tensioning allows for a certain amount of travel of the shaft 116 in the axial direction before the fingers 122 can move inwards.

With the embodiment shown in FIGS. 3 and 4, a distance a is provided between the nominal engagement point of the rounded face 122*r* with the enlarged diameter portion 116*e* and the point where the enlarged diameter begins to reduce down to the nominal diameter of the shaft 116. The distance a facilitates normal force variations so that the fingers 122 do not collapse unless the pulling force or build-up of fluid pressure on the stop 120 is sufficient to move the shaft 116 upwards by a distance that exceeds distance a. Thus, the distance a effectively provides a pre-tensioning force as the shaft 116 can tolerate force variations until it is pulled upwards by a distance that exceeds distance a.

It will be noted that there is a relationship between the slope $\beta$ and the length c (FIGS. 3 and 4) and these are connected by the change in outer diameter of the upper expansion cone formed by faces 126. The force required $F_r$ to restore the expansion cone to its original configuration where it expands the expandable member 150 decreases as the slope $\beta$ increases. This is similar to the gearing effect of FIGS. 1 and 2. Dimension a is the distance between the center of the rounded face 122*r* and the lower edge of 166*f*.

Figure 7A:
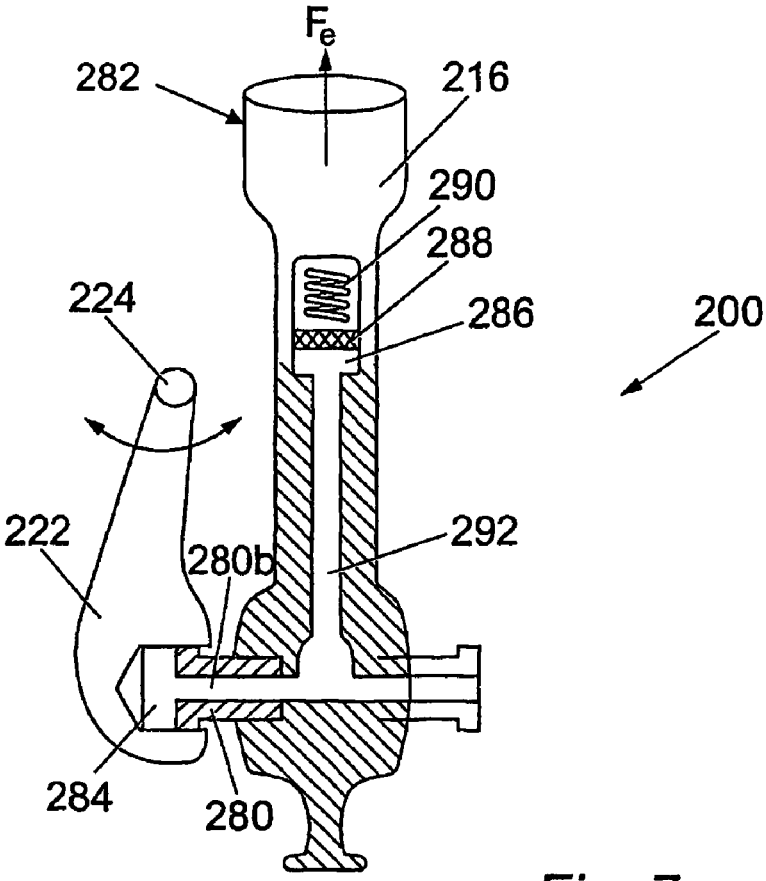
FIG. 7*a* is a cross-sectional view of a third embodiment of apparatus for radially expanding an expandable member.
Figure 7B:
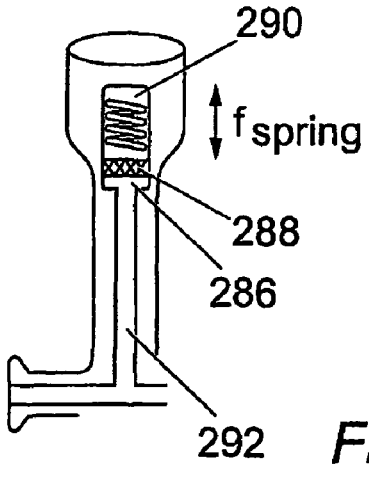
FIG. 7*b* is an enlarged view of a portion of the apparatus of FIG. 7*a;*
Figure 7C:
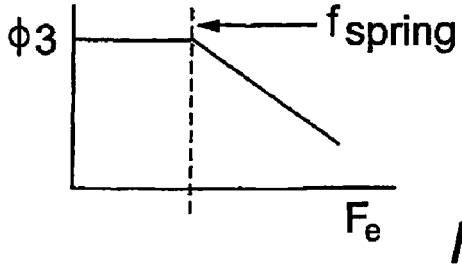
FIG. 7*c* is a graph showing a relationship between an expanding diameter of the apparatus of FIGS. 7*a* and 7*b* with the pulling force applied to the apparatus.

FIG. 7 shows a further alternative embodiment of apparatus according to the present invention. In the embodiment shown in FIG. 7, each finger 222 has a fixed piston 280 associated with it. The fixed piston 280 has an internal bore 280*b* that allows pressurised fluid from a reservoir, generally designated 282, located within the shaft 216 to flow through the piston 280 and collect in a chamber 284 behind the finger 222.

The reservoir 282 includes a fluid-filled chamber 286 that has a piston 288 located above the chamber 286, and a damping spring 290 above the piston 288. The chamber 286 communicates with the chambers 284 behind the fingers 222 via connecting channels 292.

In the FIG. 7 embodiment, the apparatus 200 is moved upwards by applying a pulling force $F_e$ to the shaft 216 as before. If the apparatus 200 encounters a restriction or resistance to upward movement, the fingers 222 that are mounted on pivots 224 move inwards. The inward movement of the fingers 222 acts on the fluid chamber 284 causing the fluid therein to be pushed inwardly into the channels 292, thus forming a radial piston. This inward movement causes the fluid pressure in the channels 292 and chamber 286 to increase and the damping spring 290 absorbs the increase in pressure, allowing the fingers 222 to move inwards so that the restriction can be passed. The damping spring 290 can be any conventional spring, such as gas, mechanical etc. Once the restriction has passed, the fluid pressure reduces and the bias force of the damping spring 290 causes the fingers 222 to expand to their nominal expansion diameter by forcing fluid out of the chamber 288 into the channels 292 and into the chamber 284 behind the fingers 222.

It is possible with the embodiment shown in FIG. 7 to control the fluid pressure in the chambers 286 and 284 from the surface. Thus, the apparatus 200 can be run into an expandable member that is to be expanded in an unexpanded configuration. Once the apparatus 200 has reached its intended location within the pre-installed casing, liner etc., fluid pressure in the apparatus 200 can be increased causing the fingers 222 to assume their expanded position and the apparatus 200 can be pulled upwards to radially expand the expandable member.

As with the previous embodiment, the biasing force ($f_{spring}$) of the spring 290 can be chosen so that the fingers 222 remain extended until a predetermined pulling force $F_e$ is exceeded (see FIGS. 7*b* and 7*c*) Thus, the fingers 222 will not fully collapse until the biasing force $f_{spring}$ provided by the spring 290 is overcome. This will allow for small variations in the movement of the fingers 222 during normal use without the fingers collapsing.

Figure 8A:
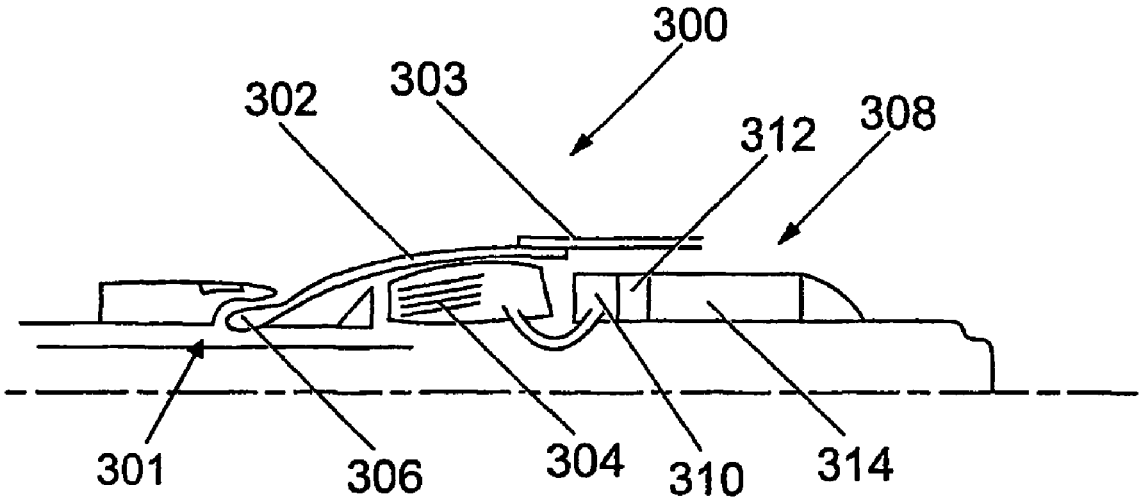
FIG. 8*a* is a cross-sectional elevation of part of a fourth embodiment of apparatus for radially expanding an expandable member.
Figure 8B:
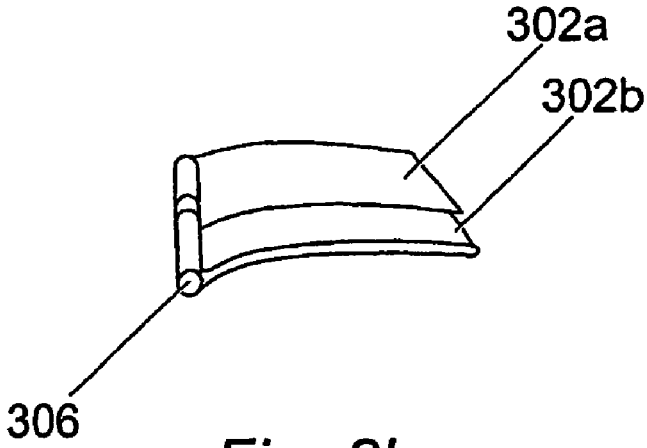
FIG. 8*b* is an enlarged view of a portion of the apparatus of FIG. 8*a*.

FIG. 8 shows a further alternative embodiment of apparatus according to the present invention. The apparatus, generally designated 300, includes a plurality of blades 302 that are pivotally connected to a body 301, typically via pins 306. Referring to FIG. 8*b*, each blade 302*a* overlaps the previous blade 302*b* and an outer surface of the blades 302 typically forms an expansion cone in use. It is preferred that each blade 302 is pivotally mounted independently of one another. The blades 302 may be restrained in the amount of outward pivotal movement by a restrainer 303 that limits the outward movement of the blade 302 by engaging one end thereof. The pivot pins 306 are typically provided at or near a leading edge of the apparatus 300.

An inflatable element 304, such as a packer, is located under the blades 302, as shown in FIG. 8*a*. The inflatable element 304 is coupled to a hydraulic absorber, generally designated 308. The hydraulic absorber 308 includes an oil reservoir 310 that is in fluid communication with the inflatable element 304. A floating piston 312 is located beside the oil reservoir 310, the piston 312 being capable of axial movement within the hydraulic absorber 308. A gas accumulator 314 is located beside the floating piston 312 and is typically filed with a gas.

In use, the inflatable element 304 is pressurised to a constant pressure that is required to move the blades 302 outwards to expand the expandable member etc. The compressibility of the gas in the gas accumulator 314 and the incompressibility of the oil in the oil reservoir 310 gives a spring effect where the radial or reactive force applied to the blades 302 from the expansion process applies a collapsing force to the inflatable element 304. The increase in pressure in the inflatable element 304 causes an increase in pressure in the oil reservoir 310 and the oil acts against the floating piston 312, forcing it into the gas accumulator 314 (as the gas therein is compressible). The movement of the piston 312 allows the blade(s) 302 to move inward(s) and thus the restriction can be passed.

The pressure within the system is typically kept constant, and thus when the restriction has been passed, the pressure in the inflatable element 304 returns to its original value, as the pressure in the oil reservoir 310 reduces, allowing the gas in the accumulator 314 to expand and the piston 312 moves back to its original position, forcing oil into the inflatable element 304.

The gas accumulator 314 could be pressurised at the surface using a gas line for example, or downhole using a system that is similar to the Baker Model E-4 Wireline Pressure Setting Assembly (Product Number 437-02). In this embodiment, an electric current is used and transmitted through electric wireline, to ignite a power charge in a setting assembly. The setting assembly is slow-burning charge that releases a gas as it burns, thus building up pressure in the gas accumulator 314. Thus, the apparatus 300 can be inserted through the expandable member that is to be expanded in an unexpanded configuration, and then the inflatable element 304 expanded downhole by igniting the first charge that in turn ignites the power charge to build up the pressure in the gas accumulator 314. The gas pressure would then act on the piston 312, compressing the oil in the reservoir 310 causing some of the oil to be transferred to the inflatable element 304 thus pivoting the blades 302 outwardly, as shown in FIG. 8*a* to radially expand the expandable member etc.

Embodiments of the present invention provide numerous advantages over prior art expander devices, such as the ability to bypass restrictions without becoming arrested. In certain embodiments, the fingers or blades that make up the expansion cone are capable of collapsing inwards so that the restriction can be passed. Thereafter, the fingers or blades are moved back to their expanded configuration so that the expansion process can continue.

Modifications and improvements may be made to the foregoing without departing from the scope of the present invention.

The invention claimed is:

1. An apparatus for expanding a downhole tubular, the apparatus comprising:

a first member, at least one radially movable portion configured to radially expand the downhole tubular wherein the at least one radially movable portion is moveable between a first radially expanded position and a second radially retracted position;

one or more pivot pins configured to pivotally couple the at least one radially movable portion to the first member, wherein the at least one radially movable portion is adapted to pivot about the pivot pins between the first radially expanded position and the second radially retracted position;

a second member comprising a shaft having an enlarged portion configured to bear against the at least one radially movable portion in the first radially expanded position; and a force isolating mechanism acting between the first and second members.

2. Apparatus according to claim 1, wherein the first member comprises a housing with a blind bore.

3. Apparatus according to claim 1, wherein the enlarged portion is a cone.

4. Apparatus according to claim 3, wherein the shaft and cone can move axially with respect to the first member in and out of engagement with the at least one radially movable portion.

5. Apparatus according to claim 3, wherein the force isolating mechanism comprises a spring.

6. Apparatus according to claim 5, wherein the at least one radially movable portion is in a radially expanded position when the cone is in a first position in which the spring is contracted.

7. Apparatus according to claim 6, wherein the second member can move axially under an axial pulling force, and the cone can move to a second position that allows the at least one radially movable portion to move radially inward to bypass a restriction.

8. Apparatus according to claim 7, wherein as the restriction is passed, the axial pulling force drops below a biasing force of the spring so that the spring contracts, and the cone moves into engagement with the at least one radially movable portion causing it to move radially outward to the radially expanded position.

9. Apparatus according to claim 7, wherein the engagement of the at least one radially movable portion with the restriction can cause it to move inwards against the cone thereby moving it to the second position in which the spring is extended.

10. Apparatus according to claim 1, wherein the at least one radially movable portion is coupled to the first member so that it can move in a radial and an axial direction relative to the first member.

11. The apparatus of claim 10, further comprising one or more axial elongated slots in the first member configured to provide a tract in which the at least one radially movable portion travels as it moves axially relative to the first member.

12. Apparatus according to claim 1, wherein an outer face of the at least one radially movable portion defines a cone.

13. The apparatus of claim 1, wherein the second member bears against the at least one radially moveable portion in the first radially expanded position.

14. The apparatus of claim 1, wherein the at least one radially movable portion has a variable expansion diameter configured to expand the downhole tubular to an expanded diameter.

15. The apparatus of claim 14, wherein the expanded diameter comprises a plurality of diameters.

16. The apparatus of claim 1, further comprising a bore located through the second member configured to facilitate the flow of wellbore fluids through an interior of the apparatus.

17. The apparatus of claim 16, further comprising a second bore located through the second member configured to facilitate the flow of wellbore fluids through the interior of the apparatus.

18. The apparatus of claim 1, further comprising a fluid configured to hydraulically push the apparatus during expansion.

19. An apparatus for expanding a tubular, comprising:

a substantially cylindrical housing having at least two apertures through a wall of the cylindrical housing;

at least two radially movable segments disposed at least partially within the apertures and configured to move through the at least two apertures and into contact with the tubular during expansion of the tubular;

a shaft axially moveable between a first position and a second position relative to the housing, wherein in the first position an enlarged diameter portion of the shaft contacts an inside surface of the segments to maintain the segments in an extended position to radially expand the tubular, and in the second position the enlarged diameter portion displaces to permit inward movement of the segments; and a resilient member for biasing the shaft to the first position when an axial force is applied to the shaft and configured to move the shaft to the second position upon a larger predetermined axial force applied to the shaft.

20. The apparatus of claim 19, wherein the at least two radially movable segments are pivotally coupled to the housing in order to pivot the radially movable segments between the extended position and a retracted position which coincides with a second position of the shaft.

21. The apparatus of claim 20, further comprising two or more pivot pins for pivotally coupling the segments to the housing wherein the two or more pivot pins are coupled around a circumference of the housing.

22. The apparatus of claim 19, wherein the enlarged diameter portion includes a sloping portion for contacting a mating sloping portion of the inside surface of the segments, an angle of the sloping portion and the mating sloping portion is selected relative to the predetermined axial force.

23. The apparatus of claim 19, wherein the resilient member is a spring.

24. The apparatus of claim 14, wherein the segments are configured to radially expand the tubular when the shaft is in the second position.

25. The apparatus of claim 19, wherein in the second position an outer diameter of the radially movable segments is smaller than the outer diameter of the housing.

26. The apparatus of claim 25, wherein in the second position each of the radially movable segments is located entirely within the housing.

27. The apparatus of claim 19, further comprising one or more axial elongated slots in the housing configured to provide a guide path in which the one or more radially movable segments travel in an axial direction relative to the housing.

28. A method of expanding a tubular in a wellbore, comprising:

providing an expander device having one or more radially extendable members, the one or more radially extendable members are pivotally coupled to a housing;

engaging the tubular with an outer surface of the one or more radially extendable members in order to expand the tubular while the one or more radially extendable members are in a first position in which the one or more radially extendable members have an extended outer diameter;

actuating a force isolation member in response to increasing a pulling force in a shaft due to the encountering of a restriction in the wellbore thereby moving the shaft axially relative to the housing; and pivoting the one or more radially extendable members to a second position in which the one or more radially extendable members have a retracted outer diameter in response to moving the shaft.

* * * * *

UNITED STATES PATENT AND TRADEMARK OFFICE

CERTIFICATE OF CORRECTION

PATENT NO. : 7,243,722 B2
APPLICATION NO. : 10/470393
DATED : July 17, 2007
INVENTOR(S) : Peter Oosterling and Alan MacKenzie It is certified that error appears in the above-identified patent and that said Letters Patent is hereby corrected as shown below:

On the Title page, in item (57), Abstract:

In the third line, please delete the two instances of [fingers] before "(22)" and insert --portions--.

In the fifth line, before "(22)", please delete [fingers] and insert --portions--.

In the fifth line, between the phrases "extended to" and "form a cone", please delete [a].

In the seventh line, after "movable", please delete [fingers] and insert --portions--.

In the Claims section:

Column 18, Claim 24, line 26, please delete [14] and insert --19--.

Signed and Sealed this

First Day of April, 2008

JON W. DUDAS
*Director of the United States Patent and Trademark Office*